United States Patent [19]

Warner et al.

[11] 4,454,710

[45] Jun. 19, 1984

[54] BALLOON CONTROL FOR YARN TEXTURING MACHINE

[75] Inventors: Charles E. Warner; William J. Schroder, both of Spartanburg, S.C.

[73] Assignee: Milliken Research Corporation, Spartanburg, S.C.

[21] Appl. No.: 434,899

[22] Filed: Oct. 18, 1982

[51] Int. Cl.[3] ..... D01H 7/18; D02G 1/02; B65H 49/00; B65H 57/22

[52] U.S. Cl. ..... 57/354; 57/59; 57/284; 57/351; 242/150 M

[58] Field of Search ..... 57/58.59, 58.7, 58.72, 57/58.83, 58.86, 90–94, 100, 127.5, 127.7, 206, 208, 264, 282, 283, 284, 351, 352, 354, 59; 242/150 M, 131, 140, 131.1

[56] References Cited

U.S. PATENT DOCUMENTS

| | | | |
|---|---|---|---|
| 2,624,527 | 1/1953 | Von Kohorn | 242/155 |
| 2,705,362 | 4/1955 | Roughsedge | 28/51 |
| 2,724,065 | 11/1955 | Saxl | 310/93 |
| 2,931,090 | 4/1960 | Field, Jr. | 28/1 |
| 2,946,177 | 7/1960 | Scragg et al. | 57/284 |
| 2,978,203 | 4/1961 | Westall et al. | 242/155 |
| 2,999,351 | 9/1961 | Davenport et al. | 57/140 |
| 3,011,736 | 12/1961 | Furst et al. | 57/352 X |
| 3,016,681 | 1/1962 | Andremont | 57/354 X |
| 3,022,025 | 2/1962 | Saxl | 242/155 |
| 3,047,932 | 8/1962 | Pittman et al. | 28/1 |
| 3,053,474 | 9/1968 | Luntz et al. | 242/150 M |
| 3,095,630 | 7/1963 | Pittman | 28/1 |
| 3,100,091 | 8/1963 | Mindheim et al. | 242/150 M |
| 3,106,442 | 10/1963 | Compostella et al. | 18/48 |
| 3,112,600 | 12/1963 | Stoddard et al. | 57/34 |
| 3,113,746 | 12/1963 | Steen | 242/155 |
| 3,152,436 | 10/1964 | Dudzik et al. | 57/157 |
| 3,194,000 | 7/1965 | Eldridge et al. | 57/34 |
| 3,352,511 | 11/1967 | Wiggins | 242/155 |
| 3,438,194 | 4/1969 | Cerutti et al. | 57/157 |
| 3,457,715 | 7/1969 | Eldridge et al. | 57/6 |
| 3,606,196 | 9/1971 | Heard | 242/155 M |
| 3,724,409 | 4/1973 | Olney, Jr. | 112/255 |
| 3,782,091 | 1/1974 | Spurgeon | 57/34 HS |
| 3,797,775 | 3/1974 | White | 242/155 M |
| 3,831,880 | 8/1974 | White et al. | 242/156 |
| 3,897,916 | 8/1975 | Rosen | 242/155 M |
| 4,035,879 | 7/1977 | Schippers | 28/246 |
| 4,112,561 | 9/1978 | Norris et al. | 57/91 X |
| 4,186,896 | 2/1980 | Brandenberger et al. | 242/131 |
| 4,313,578 | 2/1982 | Wilson et al. | 242/150 M |

*Primary Examiner*—Donald Watkins

*Attorney, Agent, or Firm*—Earle R. Marden; H. William Petry

[57] ABSTRACT

Method and apparatus to produce a continuous filament textured yarn with unusually low crimp contractions and intermittent crimp along its length. This is accomplished by the use of an electromagnetic tension device to control the draw in the yarn being supplied to a false twist device driven at a speed to provide low false twist in the yarn being twisted. The apparatus includes a control between the electromagnetic tension control and the yarn supply package to prevent the yarn coming off the package from rotating in a full balloon path and consequently prevent entanglement of the yarn in the yarn guides to a yarn consuming machine.

4 Claims, 2 Drawing Figures

BALLOON CONTROL FOR YARN TEXTURING MACHINE

This invention relates generally to the employment of an electromagnetically actuated disc tension control to intermittently grasp and release a continuous filament synthetic yarn which is being processed downstream of the tension control.

It is an object of the invention to provide a yarn processing system which employs a disc tension control to randomly vary the tension of a yarn being processed in a yarn processing machine.

Figure 1:
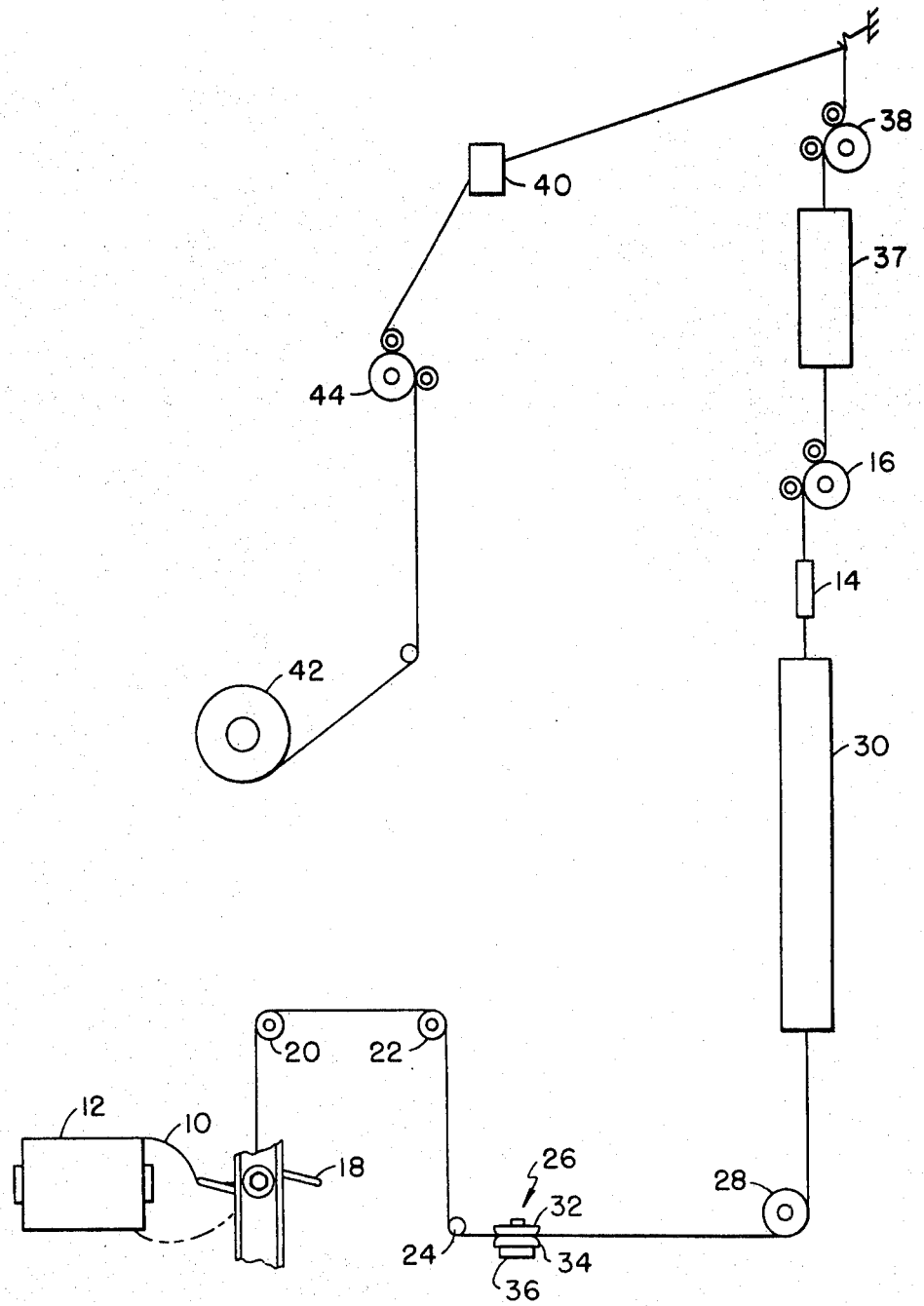
Figure 2:
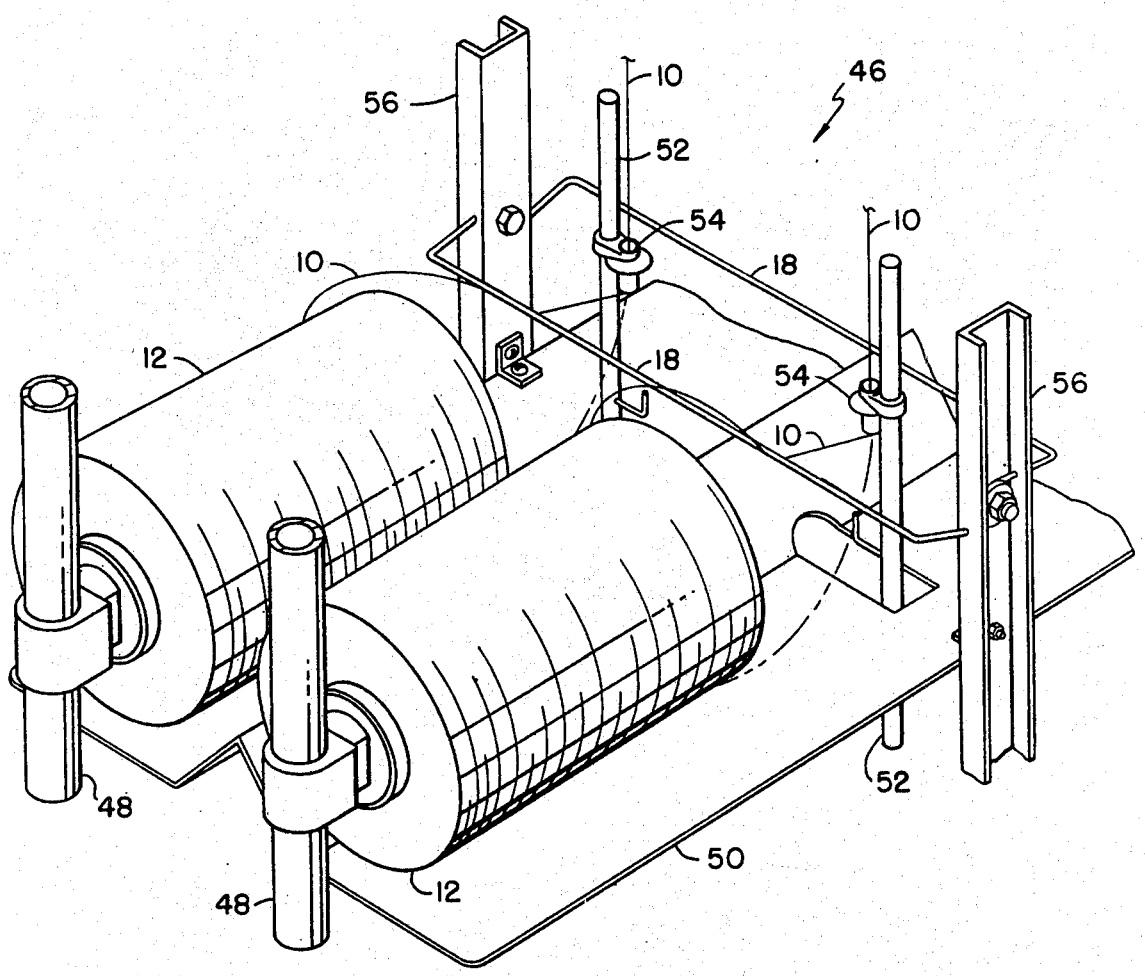

Other objects and advantages of the invention will become readily apparent as the specification proceeds to describe the invention with reference to the accompanying drawings, in which:

FIG. 1 is an overall schematic representation of the new and novel system to produce a textured, continuous filament synthetic yarn; and FIG. 2 is a partial perspective view of the yarn supply creel for the system shown in FIG. 1.

Looking now to FIG. 1, the overall system of FIG. 1 will be explained to obtain the novel disclosed yarn. The system is directed to a method to produce a specially textured yarn by intermittently varying the draw of a continuous filament partially oriented, synthetic, multifilament yarn such as polyester. The multifilament yarn 10 is supplied from a supply package 12 to the false twist device 14 by the feed roll device 16. The yarn 10 from the package 12 successively, in its travel to the feed roll device 16, passes through the balloon control apparatus 18, over the guide members 20, 22 and 24 through the electromagnetically controlled tension disc apparatus 26 and under the guide member 28 through the primary heater 30 and false twist device 14 to the feed roll device 16. The yarn 10 is intermittently and randomly drawn in the primary heater 30 by the intermittent hold back action of the disc tension apparatus 26. The discs 32 and 34 are intermittently and randomly drawn together and released on the yarn 10 by the action of the electromagnet 36 controlled by the varying voltage supplied thereto by a suitable voltage source which is varied by the action of a random signal generator.

From the feed roll device 16 the textured yarn passes through the secondary heater 37 with very little overfeed since the speed of the feed roll device 38 is substantially the same as the feed roll device 16 and the crimp in the yarn is allowed to set. Depending on the amount of crimp contraction desired the secondary heater can be either turned on at an appropriate temperature or off or by-passed and the overfeed varied from high to very little.

The feed roll device 38 is driven at a higher speed than the feed roll device 44 to overfeed the textured yarn through the air jet entangling device 40 to commingle and entangle the individual filaments of the textured yarn. From the feed roll device 38 the entangled, textured yarn is slightly overfed to the yarn take-up package 42 by the feed roll device 44.

Schematically in FIG. 1, the yarn package 12 and the balloon control element 18 are shown as separate items but in actual practice a creel unit, designated 46 in FIG. 2, is used. The creel unit 46 supports a plurality of packages 12 for a plurality of false twist spindle positions and is slid in and out of position relative to a multiple spindle false twisting machine. In FIG. 2 a partial creel is shown supporting a pair of supply packages held on creel pins supported by creel pin support members 48 that are connected to the creel. Also connected to the creel is a horizontal separation plate 50 through which the yarn guide supports 52 project. A yarn guide 54 for each yarn package is connected thereto to guide the yarn 10 from the package 12 towards the guide member 20. Mounted on both sides of the horizontal separator plate 50 is a channel beam 56 between which is connected the balloon control apparatus or bar 18. As shown in FIG. 2 the bar 18 prevents yarn 10 from the package 12 from forming a full balloon and getting entangled in and around various elements of the creel, such as yarn guides 54. As shown in FIG. 2, a second bar 18 is shown which is used for the same purpose for the yarn packages (not shown) on the opposite side of the creel unit 46.

In the form described hereinabove the preparation of a single end of multifilament synthetic yarn is described but, depending on the ultimate use of the yarn produced, a plurality of yarns can be interlaced or commingled in the air jet 40. Examples of such yarn are set forth below.

EXAMPLE 1

Two ends of a 240 denier, 68 filament DuPont 56T polyester yarn were processed as described above and commingled in the air jet 40 to provide a 2/150/68 yarn with an actual denier of 355. The elongation was 51% with a crimp contraction of 1%. The operating conditions were as follows:

False Twist Spindle Speed: 96000 RPM
Yarn Speed through Spindle: 117 yards/minute
False Twist: 23 turns/inch
Twist Multiple: 306
Direction: "S"
Yarn Overfeed Through Heater 37: By-passed
Yarn Overfeed Through Air Jet: 4.0%
Yarn Overfeed to Take-Up: 1.7%
Temperature of Heater 30: 180° C.
Temperature of Heater 37: Off
High Pre-Spindle Tension Average: 50 grams
Low Pre-Spindle Tension Average: 12 grams The yarn thus produced has a very low crimp contraction with high luster and intermittent character.

EXAMPLE 2

Two ends of a 220 denier, 54 filament DuPont 693T polyester yarn were processed and entangled in the air jet 40 to provide a 2/150/54 yarn with an actual denier of 328. The elongation was 48% with a crimp contraction of 1.8%. The operating conditions were as follows:

False Twist Spindle Speed: 129,000 RPM
Yarn Speed through Spindle: 127 yards/minute
False Twist: 28 turns/inch
Twist Multiple: 359
Direction: "S"
Yarn Overfeed through Heater 37: 0
Yarn Overfeed through Air Jet: 4.0%
Yarn Overfeed to Take-up: 1.7%
Temperature of Heater 30: 180° C.
Temperature of Heater 37: 190° C.
High Pre-Spindle Tension Average: 50 grams
Low Pre-Spindle Tension Average: 16 grams The yarn produced has a very low crimp contraction with very high luster and intermittent character.

EXAMPLE 3

One end of a 115 denier, 34 filament DuPont 693T polyester yarn was processed and entangled in the air jet 40 to provide a 1/70/34 yarn with an actual denier of 78. The elongation was 34% with a crimp contraction of 0.7%. The operating conditions were as follows:

False Twist Spindle Speed: 269,000 RPM
Yarn Speed through Spindle: 156 yards/minute
False Twist: 48 turns/inch
Twist Multiple: 424
Direction: "S"
Yarn Overfeed through Heater 37: 5.0%
Yarn Overfeed through Air Jet to Take-Up: 3.9%
Temperature of Heater 30: 180° C.
Temperature of Heater 37: 190° C.
High Pre-Spindle Tension Average: 35 grams
Low Pre-Spindle Tension Average: 15 grams This yarn has a very low crimp contraction and a very high luster.

It has been found that the most desirable low crimp, high luster yarn was produced when the twist multiple for the yarn is between 250–450. The twist multiple (TM) is equal to the turns per inch (TPI) of twist imparted to the yarn multipled by the square root of the yarn denier (Yd) ($TM = TPI \times \sqrt{Yd}$).

It can readily be seen that the described apparatus and method provides a randomly, intermittently textured, continuous multifilament synthetic yarn which along its length has variable bulk, torque, twist and shrinkage. The produced yarn has a low crimp contraction with a high luster. This yarn is especially useful in the fabrication of a velvet-type upholstery fabric and provides unique visual effects due to its variable dye affinity. The yarn of Example 3 is especially useful in the fabrication of woven and knit fabric and provide unique silk-like stria effects and hand.

Although the preferred embodiment of the invention has been described, it is contemplated that many changes may be made without departing from the scope or spirit of the invention and it is desired that the invention be only limited by the scope of the claims.

We claim:

1. Method to produce a false twisted, continuous multifilament synthetic yarn comprising the steps of: supplying a continuous multifilament yarn from a supply package through a heater to a false twisting device, interrupting the balloon path of the yarn supplied to the false twisting device as it is supplied from the supply package, intermittently and randomly varying the supply of yarn to the false twisting device, driving the false twist device at a speed to produce a twist multiple between 250 and 450 in the multifilament yarn, allowing the yarn to be set after false twisting and taking up the false twisted yarn.

2. The method of claim 1 wherein the false twisted yarn is commingled in an air entanglement device prior to take-up.

3. Apparatus to produce a false twisted multifilament yarn comprising: yarn creel means, a false twist device, a heater means located between said yarn creel and said false twist device, a disc type tension means located between said heater means and said yarn creel means to intermittently and randomly vary the flow of yarn from said creel means to said false twist device, a first means to supply yarn from said yarn creel means to said false twist device, a second means operably associated with said yarn creel means to interrupt the balloon path of the yarn from said yarn creel means being supplied to said false twist device, intermittently and randomly varying the supply of yarn to the false twisting device, driving the false twist device at a speed to produce a twist multiple of between 250 and 450 in the multifilament yarn, allowing the yarn to be set after false twisting and taking up the false twisted yarn, and a third means to supply false twisted yarn from said false twist device to a take-up means to take-up the false twisted yarn.

4. The apparatus of claim 3 wherein an air jet commingling means is located between said third means and the take-up means to commingle the filaments of the yarn false twisted in said false twist device.

* * * * *